US005553951A

United States Patent [19]

Simpson et al.

[11] Patent Number: 5,553,951

[45] Date of Patent: Sep. 10, 1996

[54] HEATED PLATEN AND ROLLERS TO ELEVATE TEMPERATURE OF RECEIVER IN A THERMAL PRINTER

[75] Inventors: William H. Simpson, Pittsford; Jacob J. Hastreiter, Jr., Spencerport; Mark S. Janosky; Mark A. Bobb, both of Rochester, all of N.Y.

[73] Assignee: Eastman Kodak Company, Rochester, N.Y.

[21] Appl. No.: 373,824

[22] Filed: Jan. 17, 1995

[51] Int. Cl.[6] ..... B41J 2/315

[52] U.S. Cl. ..... 400/120.18; 400/120.01; 347/187

[58] Field of Search ..... 400/120.01, 120.08, 400/120.18, 120.14; 347/187

[56] References Cited

U.S. PATENT DOCUMENTS

| | | | |
|---|---|---|---|
| 4,733,251 | 3/1988 | Murakami et al. | 346/76 PH |
| 4,880,769 | 11/1989 | Dix et al. | 503/227 |
| 5,043,741 | 8/1991 | Spehrley, Jr. | 346/1.1 |
| 5,113,201 | 5/1992 | Mano et al. | 347/187 |
| 5,246,910 | 9/1993 | Koshizuka et al. | 503/227 |
| 5,270,283 | 12/1993 | Koshizuka et al. | 503/227 |
| 5,342,132 | 8/1994 | Tanaka et al. | 400/120.18 |

FOREIGN PATENT DOCUMENTS 05238174 9/1993 Japan .

*Primary Examiner*—Edgar S. Burr
*Assistant Examiner*—Steven S. Kelley
*Attorney, Agent, or Firm*—Milton S. Sales

[57] ABSTRACT

An interactive dye thermal transfer printing apparatus and process uses a dye donor layer and a dye receiver layer, passing the dye donor layer and the opposed receiver layer between a thermal print head and a platen heated to raise the temperature of the dye receiver layer to its glass transition temperature. The thermal print head is image-wise energized to diffuse dye from the dye donor layer to the dye receiver layer. At the same time, thermal energy is transferred from the platen to the dye receiver layer to provide energy to react the dye with the receiver layer.

5 Claims, 2 Drawing Sheets

HEATED PLATEN AND ROLLERS TO ELEVATE TEMPERATURE OF RECEIVER IN A THERMAL PRINTER

BACKGROUND OF THE INVENTION

1. Field Of The Invention

The present invention relates to dye diffusion thermal transfer printers.

2. Background Art

Dye diffusion thermal transfer involves the transport of a dye, or dyes, by the physical process of diffusion from a dye donor layer into a dye receiver layer. The highest rate of diffusion of the dye occurs when the glass transition temperature of the receiver layer is below that of the lowest temperature obtained during printing with the thermal head. Thus, high color densities are obtained under these conditions. In non-interactive dye diffusion, there is no chemical reaction between the dye and the receiver layer. These dyes are retained in the receiver matrix under ambient temperature conditions because the ambient temperatures are below the glass transition temperature $T_g$ of the dye receiver layer, and because diffusion is extremely slow below the glass transition temperature of the receiver layer.

Some known dyes chemically interact with the dye receiver matrix after being transferred by diffusion to the receiver layer from the dye donor layer. These are called "interactive" dyes, and they fall into several categories such as, for example: metallizable dyes as disclosed in U.S. Pat. No. 5,246,910; acid-base interaction dyes as disclosed in JP 05238174; dyes which can be protonated as disclosed in U.S. Pat. No. 4,880,769; and dyes capable of covalent bond formation as disclosed in U.S. Pat. No. 5,270,283.

Transfer of an interactive dye involves diffusion of a dye precursor into the receiver layer, followed by reaction of the dye with the receiver matrix to form a color. When interactive dyes react with the receiver matrix, the result is a strongly bound dye which does not depend on the glass transition temperature of the receiver layer for keeping properties. Receivers with low glass transition temperatures $T_g$ are used to expedite movement of the dye precursor from the receiver surface and into the receiver layer. Thus, higher dye transfer efficiencies can be obtained during the initial printing step with a lower energy input.

However, color formation in the dye receiver layer depends on a chemical reaction, and the color density may not fully develop if the thermal energy (the temperature attained or the time elapsed) is too low. Thus, color development is often augmented by a post-printing step such as thermal fusing. This practice adds extra time and cost to the printing process, and is therefore not desirable.

Accordingly, there has been a need for an interactive dye printing process that results in greater thermal energy transferred to the receiver than that obtained with conventional thermal heads alone so that interactive dyes can be caused to undergo more extensive reaction during the transfer step, yielding higher color densities.

SUMMARY OF THE INVENTION

It is an object of the present invention to provide an interactive dye printing process that results in greater thermal energy transferred to the receiver than that obtained with conventional thermal heads alone so that interactive dyes can be caused to undergo more extensive reaction during the transfer step, yielding higher color densities.

It is another object of the present invention to provide a receiver media transport mechanism which controls the temperature of the receiver during printing operations.

According to one feature of the present invention, the above objects are achieved by providing a temperature-controlled platen.

According to another feature of the present invention, the above objects are achieved by providing a temperature-controlled roller upstream of the print head for controlling receiver temperature prior to the print head.

According to still another feature of the present invention, the above objects are achieved by providing a temperature-controlled roller downstream of the print head for controlling receiver temperature after to the print head.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
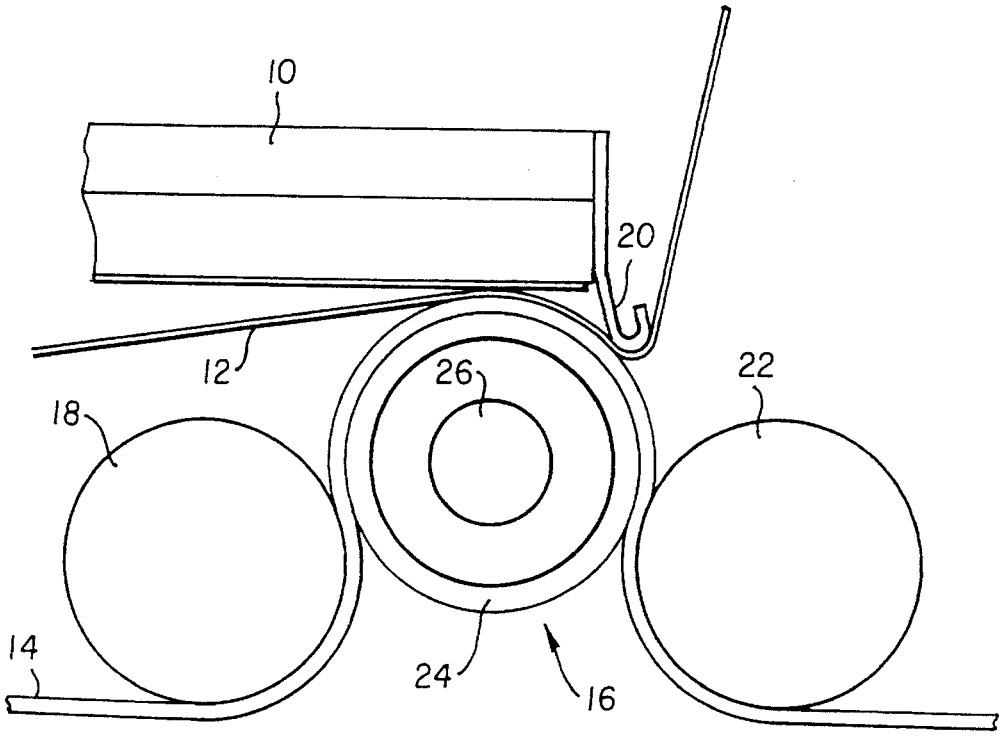
FIG. 1 shows a preferred embodiment of the present invention in which an upstream roller and a downstream roller hold receiver media against a temperature-controlled platen.

Referring to FIG. 1, a thermal print head 10 presses a dye donor web 12 and a receiver media 14 against a platen. the platen is preferably a roller 16, although a non-roller platen may be used. The receiver passes an upstream roller 18 prior to contacting the platen so that the receiver presses against the platen for a distance prior to entering the nip formed by the print head and the platen. Donor web 12 and receiver media 14 continue pressed together from the nip to a donor web guide 20, located downstream from the print head. The donor web is stripped from the receiver media at the donor guide. The receiver media continues against the platen until the receiver leaves the platen at a downstream roller 22. The finished print then proceeds out of the printer.

Platen roller 16 is formed of a hollow cylinder 24 and a heat source 26 located within the hollow cylinder. The heat source is controlled by circuitry (not shown) which maintains the temperature of the outer surface of the platen roller within a desired predetermined temperature range. This control circuitry may include temperature sensors (not shown) and the like to monitor platen temperature. One example of a heat source is an infrared light source, although other heat sources are equally feasible.

Upstream roller 18 presses the receiver media to platen roller 16, forming a nip between roller 18 and the platen roller. This is not necessary, however, as the upstream roller may be spaced from the platen roller, or eliminated. Similarly, downstream roller 22 is shown pressing the receiver media to platen roller 16, forming a downstream nip between roller 22 and the platen roller. This also is not necessary. Again, the downstream roller may be spaced from the platen roller, or eliminated.

Figure 2:
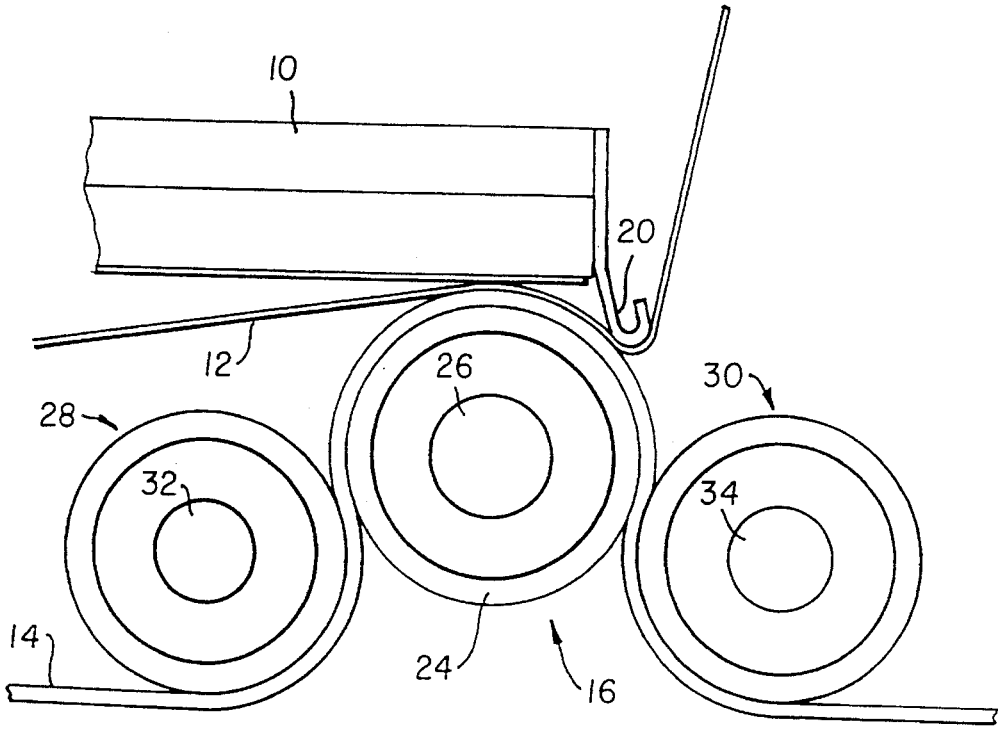
FIG. 2 shows another preferred embodiment of the present invention, wherein one or both of the upstream and downstream rollers are temperature-controlled.

It is also possible to provide temperature-controlled rollers in addition to a temperature-controlled platen in the receiver media transport mechanism. As shown in FIG. 2, both an upstream roller 28 and a downstream roller 30 are similar to platen roller 16 in that the upstream and downstream rollers are formed of hollow cylinders with heat sources 32 and 34, respectively.

One or more upstream or downstream temperature-controlled rollers provides much greater temperature control of the receiver media during the printing process. For instance, upstream roller 28 could bring the receiver from ambient to a first temperature. Platen roller 16 would then be required only to bring the receiver media from the first temperature to a second, higher temperature. Downstream roller 30 would maintain the receiver media at a third temperature that may be different from the first and/or second temperatures. The temperatures of the rollers can be the same or different.

Figure 3:
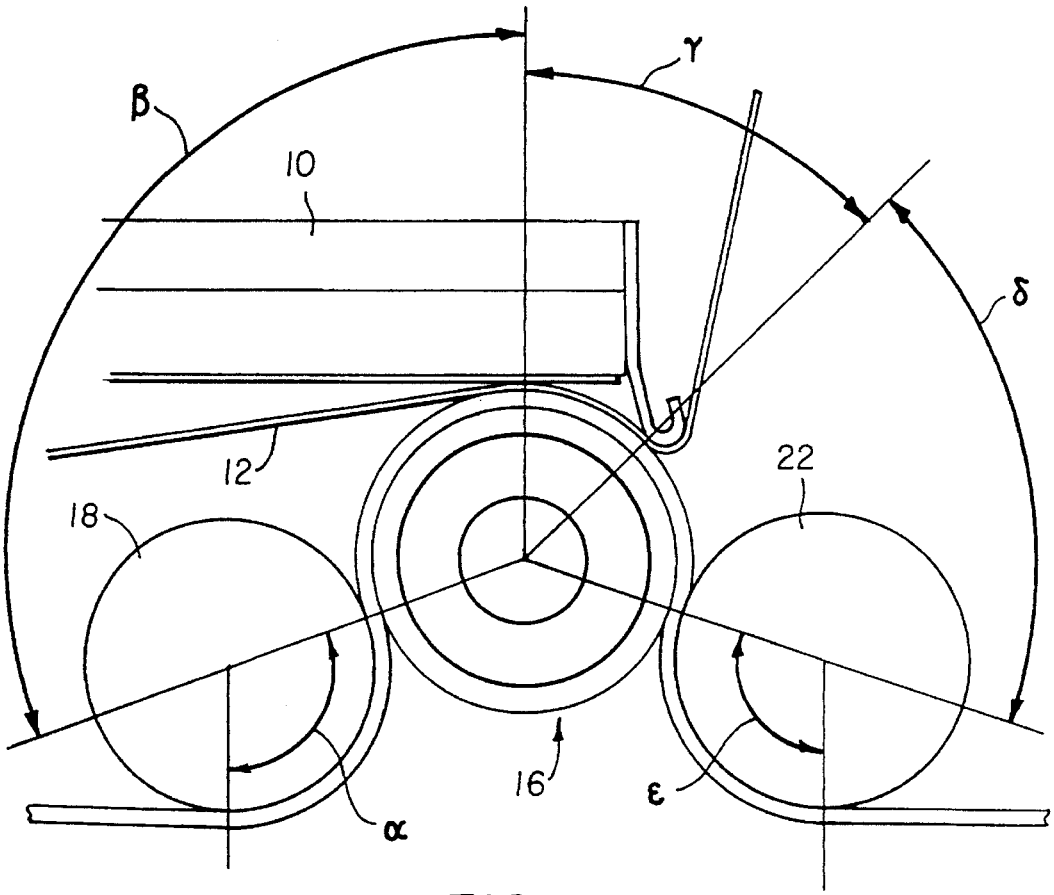
FIG. 3 shows various arcs the receiver media follows in the receiver media transport mechanism of the present invention.

FIG. 3 identifies several dimensions. A first arc angle, $\alpha$, is defined by that portion of the upstream roller that the receiver contacts. This first arc angle determines the amount of time the receiver media contacts the temperature controlled upstream roller. The second arc angle, $\beta$, is defined by the portion of the platen roller that the receiver contacts prior to the print head. This second arc determines the amount of time the receiver media contacts the temperature controlled platen prior to printing.

The third arc, $\gamma$, is defined by the portion of the platen roller contacted by the receiver media and donor web sandwich after the print head. This third arc determines the amount of time the receiver media contacts the temperature controlled platen roller after printing, while the donor web is still pressed to the receiver. This time period can affect the cooling time of the dye after printing; impacting image quality.

The fourth arc, $\delta$, is defined by the portion of the platen contacted by the receiver media after the donor web has been stripped from the receiver media by the donor guide. This fourth arc determines the amount of time that the receiver media contacts the temperature controlled platen after the donor web is stripped from the receiver media.

Finally, the fifth arc, $\epsilon$, is defined by the portion of the downstream roller contacted by the receiver media after the receiver media leaves the platen. This fifth arc determines the amount of time the receiver media contacts the temperature controlled downstream roller.

The invention has been described in detail with particular reference to preferred embodiments thereof, but it will be understood that variations and modifications can be effected within the spirit and scope of the invention.

What is claimed is:

1. An interactive dye thermal transfer printing process using a dye donor layer and a dye receiver layer; said process comprising:

passing an interactive dye donor layer and an opposed receiver layer between a thermal print head and a platen; and simultaneously (1) imagewise activating the thermal print head to diffuse dye from the dye donor layer to the dye receiver layer and (2) transferring sufficient thermal energy to the dye receiver layer to provide energy to react the dye with the receiver layer, wherein the thermal energy is transferred to the dye receiver layer both before and after dye diffusion.

2. An interactive dye thermal transfer printer using a dye donor layer and a dye receiver layer; said printer comprising:

a thermal print head and a platen which are adapted to receive there between a dye donor and a dye receiver, respectively having an interactive dye donor layer and an opposed dye receiver layer portion such that imagewise activation of the thermal print head will diffuse dye from the dye donor layer to said portion of the dye receiver layer; and means for controlling the temperature of said portion of the dye receiver layer during dye diffusion to said portion wherein said means for controlling the temperature of said portion of the dye receiver layer includes (i) means for transferring thermal energy from the platen to the dye receiver layer to provide energy to react the dye with the receiver layer and (ii) a temperature-controlled roller on both sides of the platen.

3. An interactive dye thermal transfer printer using a dye donor layer and a dye receiver layer; said process comprising:

a thermal print head and a platen roller which are adapted to receive there between a dye donor and a dye receiver, respectively having an interactive dye donor layer and an opposed dye receiver layer portion such that imagewise activation of the thermal print head will diffuse dye from the dye donor layer to said portion of the dye receiver layer; and means for heating the platen roller to control the temperature of said portion of the dye receiver layer during dye diffusion to said portion, wherein said means for heating said portion of the dye receiver layer includes a temperature-controlled roller on both sides of the platen roller.

4. An interactive dye thermal transfer printer using a dye donor layer and a dye receiver layer having a glass transition temperature; said process comprising:

a thermal print head and an opposed platen which are adapted to receive there between a dye donor and a dye receiver, respectively having an interactive dye donor layer and an opposed dye receiver layer portion such that imagewise activation of the thermal print head will diffuse dye from the dye donor layer to said portion of the dye receiver layer; and means for controlling the temperature of said portion Of the dye receiver layer to its glass transition temperature during dye diffusion to said portion, wherein said means for controlling the temperature of said portion of the dye receiver layer includes (i) means for transferring thermal energy from the platen to the dye receiver layer to provide energy to react the dye with the receiver layer and (ii) a temperature-controlled roller on both sides of the platen.

5. An interactive dye thermal transfer printer using a dye donor layer and a dye receiver layer having a glass transition temperature; said process comprising:

a thermal print head and an opposed platen roller which are adapted to receive there between a dye donor and a dye receiver, respectively having an interactive dye donor layer and an opposed dye receiver layer portion such that imagewise activation of the thermal print head will diffuse dye from the dye donor layer to said portion of the dye receiver layer; and means for heating the platen roller to control the temperature of said portion of the dye receiver layer to its glass transition temperature during dye diffusion to said portion, wherein said means for heating the platen roller to control the temperature of said portion of the dye receiver layer includes a temperature-controlled roller on both sides of the platen roller.

* * * * *